US011896063B2

(12) United States Patent
Hanson Allen et al.

(10) Patent No.: US 11,896,063 B2
(45) Date of Patent: Feb. 13, 2024

(54) RAW EDGE CONTOURING GUSSET

(71) Applicant: Spanx, LLC, Atlanta, GA (US)

(72) Inventors: Wendy Hanson Allen, Atlanta, GA (US); Deneb Torano, Atlanta, GA (US)

(73) Assignee: Spanx, LLC, Atlanta, GA (US)

( * ) Notice: Subject to any disclaimer, the term of this patent is extended or adjusted under 35 U.S.C. 154(b) by 137 days.

(21) Appl. No.: 16/173,434

(22) Filed: Oct. 29, 2018

(65) Prior Publication Data

US 2019/0125003 A1 May 2, 2019

Related U.S. Application Data

(60) Provisional application No. 62/578,636, filed on Oct. 30, 2017.

(51) Int. Cl.

| | |
|---|---|
| ***A41B 9/04*** | (2006.01) |
| ***A41B 9/00*** | (2006.01) |
| ***D04B 1/24*** | (2006.01) |

(52) U.S. Cl.

CPC ..... *A41B 9/04* (2013.01); *A41B 9/004* (2013.01); *D04B 1/24* (2013.01)

(58) Field of Classification Search

CPC ..... A41B 9/004; A41B 9/001; A41B 9/002; A41B 9/04; A41B 9/12; A41C 1/003

USPC ..... 2/93, 400, 401, 406, 407

See application file for complete search history.

(56) References Cited

U.S. PATENT DOCUMENTS

| | | | | |
|---|---|---|---|---|
| 4,031,568 | A * | 6/1977 | Huff | A41B 9/004 2/406 |
| 4,615,051 | A * | 10/1986 | Hashimoto | A41B 9/004 2/406 |
| 4,674,135 | A * | 6/1987 | Greene | A41B 9/001 2/400 |
| 5,940,887 | A * | 8/1999 | Rajala | A61F 13/72 2/243.1 |
| 8,425,275 | B2 | 4/2013 | Noel | |
| 8,661,568 | B1 * | 3/2014 | O'Brien | A41B 11/14 2/239 |
| 2008/0282452 | A1 * | 11/2008 | Suga | A61F 13/72 2/406 |
| 2008/0295227 | A1 * | 12/2008 | Welsch | D06M 15/643 2/400 |
| 2015/0107004 | A1 * | 4/2015 | Ishiura | A41B 9/001 2/406 |

OTHER PUBLICATIONS

25 Best Pairs of Seamless Underwear of 2022 (Dec. 30, 2021) Womens Health website. (Year: 2021).*

(Continued)

*Primary Examiner* — Katherine M Moran

(74) *Attorney, Agent, or Firm* — Meunier Carlin & Curfman LLC

(57) ABSTRACT

Free cut edges on undergarments help to minimize the appearance of visible panty lines. However, typical free cut undergarments are flat and do not conform to the shape of the body. The undergarment disclosed herein has free cut edges and a gusset panel that addresses the limitations of existing free cut undergarments. The gusset panel is gathered along its left and right edges using elastic thread or elastic bands. The gathering provides elasticity and shape to the gusset panel, and limits the extent to which the gusset panel slides and becomes displaced on the wearer.

20 Claims, 5 Drawing Sheets

(56) References Cited

OTHER PUBLICATIONS

Www.nordstrom.com, Butter Hipster Panty by Commando, earliest customer review of Nov. 4, 2016, 4pgs. (Year: 2016).*
Schwartzberg, "What is the Best Women's Underwear?" The 21 Best Women's Underwear and Reviews 2018, http://nymag.com/strategist/article/best-womens-underwear.html, Apr. 27, 2017.

* cited by examiner

RAW EDGE CONTOURING GUSSET

CROSS REFERENCE TO RELATED APPLICATIONS

This application claims the benefit of U.S. Provisional Application No. 62/578,636, filed Oct. 30, 2017, which is hereby incorporated by reference in its entirety for all purposes.

BACKGROUND

A visible panty line is a situation where the outline of a person's underwear is visible through the clothing. The undergarments may appear through the wearer's clothes as an outline, ridge, or depression. The unsmooth silhouette may lower the wearer's self-confidence and, in some cases, it may attract unwanted attention to the wearer's undergarments.

Undergarments with free-cut edges minimize visible panty lines by reducing bulk at the edges of the undergarment. However, for many free-cut edge undergarments, the gusset panel covering the wearer's crotch is flat and does not properly contour to the natural shape of the body. These gusset panels also do not properly anchor to the body, allowing the undergarments to move and shift uncomfortably.

SUMMARY

An undergarment is disclosed herein that addresses the aforementioned problems with free cut undergarments. The gusset panel of the disclosed undergarment has gathered edges which give a better fit to the wearer and prevent sliding and displacement of the gusset panel. The undergarment includes a front panel having a free cut left front inferior edge and a free cut right front inferior edge, a back panel having a free cut left back inferior edge and a free cut right back inferior edge, and a gusset panel extending between the front panel and back panel. The gusset panel has a right gusset edge and a left gusset edge. The left gusset edge, the left front inferior edge, and the left back inferior edge define a left leg space. The right gusset edge, the right front inferior edge, and the right back inferior edge define a right leg space. The gusset panel is gathered along the left gusset edge and the right gusset edge. In some embodiments, the left and right gusset edges are free cut.

In some embodiments, the undergarment also includes a left elastic band or thread attached to and extending along the left gusset edge of the interior surface of the garment, and a right elastic band or thread attached to and extending along the right gusset edge of the interior surface of the garment. The attachment of the left and right elastic bands or threads gather the left and right gusset edges. In some elastic band embodiments, the elastic band is a woven or knit elastic made of, for example, nylon, spandex, polyester, rayon, or other materials. In some elastic band embodiments, the left and right elastic bands are attached to the left and right gusset edges by a left and a right seam. In some elastic band embodiments, the left and right seams include polyester or polyester-cotton blend thread. In some embodiments, the attachments of the left and right elastic bands gather the left and right gusset edges. In some embodiments, the left and right seams attaching the elastic bands include a zig-zag stitch, which in some embodiments includes a three-step zig-zag stitch. In some embodiments, the zig-zag stitch has from about 15 stitches per inch to about 30 stitches per inch. In some embodiments, the gusset panel has a shirring ratio of from about 1:1.25 to about 1:1.3. In some embodiments, the left and right gusset edges include a decorative trim.

In some embodiments, the gusset panel has a lining located on an interior surface of the garment and an outer fabric on an exterior surface of the garment. In some embodiments, the lining has a back liner edge, which is attached to the outer fabric of the gusset panel with a seam.

In some embodiments, the front and back panel are formed from the same piece of fabric. In some embodiments, the front panel and the back panel are attached with side seams. In some embodiments, the front and back panel are attached along the sides by bonding. In some embodiments, the gusset panel is formed from the same piece of fabric as the front panel or the back panel, or both the front and back panel. In some embodiments, the front panel, the back panel, and the gusset panel include nylon, spandex, cotton, linen, polyester, rayon, modal, tensuel, or any combination thereof. In some embodiments, the front panel includes a free cut front superior edge and the back panel includes a free cut back superior edge.

Methods of making an undergarment having a gusset panel, a front panel, and a back panel are also disclosed herein. Methods of making the undergarment can include the steps of providing a fabric, and cutting a front panel, back panel, and gusset panel having a left and right gusset edge from the fabric. The method can include attaching the front panel, back panel, and gusset panel such that the gusset panel extends between the front panel and the back panel. The method can further include gathering the left gusset edge and the right gusset edge.

In some embodiments, the method further includes the step of attaching a left and a right elastic band or thread along the left and right gusset edges. In some embodiments, the method includes attaching a left elastic band along the left gusset edge using a left seam and attaching a right elastic band to the right gusset edge using a right seam. In some embodiments, the left and right seams include using a zig-zag stitch. In some embodiments, the method includes using a three-step zig-zag stitch. In some embodiments, gathering the left and right gusset edges includes stretching the left and right elastic bands or threads, and attaching the stretched left elastic band or thread along the left gusset edge and attaching the stretched right elastic band along the right gusset edge. Gathering the gusset edges using a stretched elastic thread further comprises stitching the stretched elastic thread along the left and right gusset edges. Gathering the gusset edges using stretched elastic bands further comprises stitching the stretched elastic bands along the left and right gusset edges using seams, as described above.

DETAILED DESCRIPTION

Figure 1:
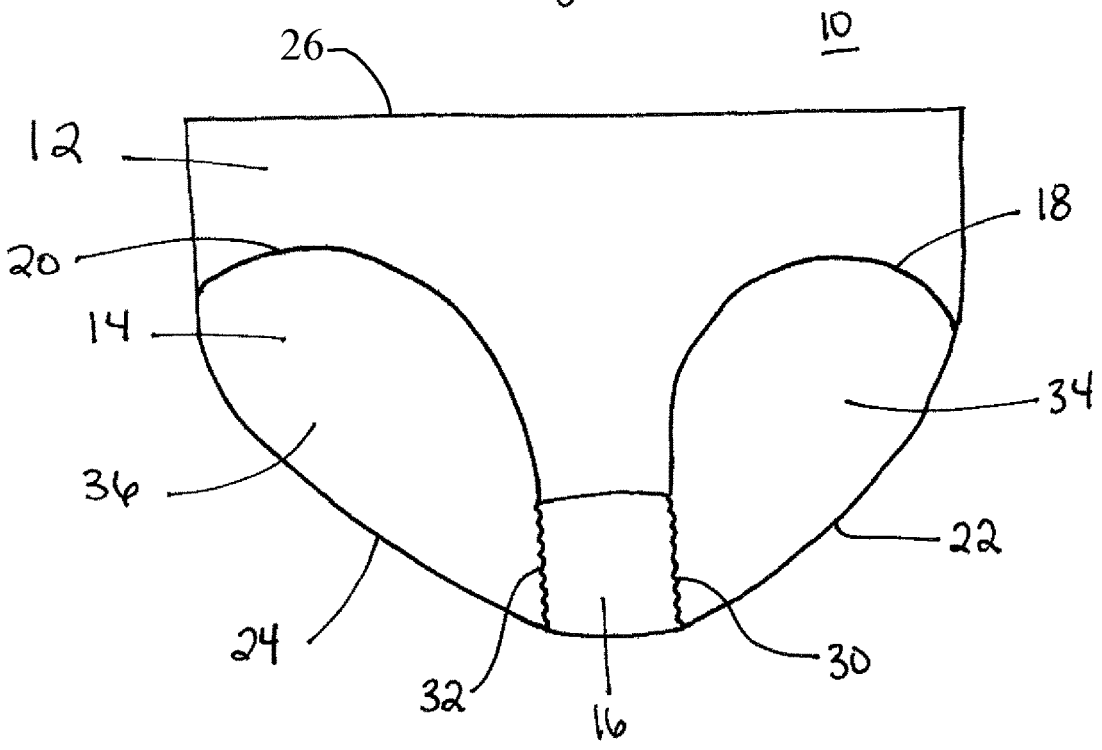
FIG. 1 is a front view of an embodiment of the undergarment.

As described above, it is often desirable to minimize the appearance of visible panty lines under garments. Undergarments with free-cut edges provide a solution for minimizing visible panty lines. However, the gussets of many free-cut edge undergarments do not properly contour to the body. Gussets of many free-cut edge undergarments are flat, which fights against the natural shape of the body. These gussets also do not allow for proper anchoring and can cause the undergarments to move or shift on the body. The undergarment disclosed herein addresses the limitations of existing gusset panels in free-cut undergarments.

An undergarment is described herein that includes a gusset panel. The gusset panel extends between the front panel and the back panel of the undergarment. The gusset panel is structured such that it contours to the body. The gusset panel has a left gusset edge and a right gusset edge. In some embodiments, the left and right gusset edges are free-cut. The left gusset edge and right gusset edge have ruching or gathering, which creates a cup-like shape and allows the left and right gusset edges to contour to the body and prevents the gusset panel from moving out of place. The gathering and the cup-like shape also allow the gusset panel to flex and to conform to different body shapes, providing fit and comfort. The gathering also allows garments with free-cut or laser-cut edges to anchor to the body, holding the garments in place and preventing them from riding up.

The gathering is a rippling or bunching of the fabric along the left and right gusset edges. In some embodiments, the left and right gusset edges only have slight gathering, creating a slight rippling of the fabric. In some embodiments, the left and right gusset edges are tightly gathered. In some embodiments, the gathering is created by placing an elastic band, elastic thread, or similar elastic structure under tension, attaching it to the fabric, and then releasing the tension to create gathering or bunching of the fabric. The amount of gathering can be adjusted by changing the dimensions or type of seams connecting the elastic bands or thread to the fabric, the tension of the elastic bands or thread, the type fabric or elasticity of the gusset panel, or other adjustments.

As used herein, fixedly attached is defined as attached via sewing or bonding. Seamlessly attached is defined as continuously formed as one stretch of fabric. Seamless attachment can be achieved by knitting two or more portions or panels of the undergarment together as one piece of fabric, such that there is no seam joining the portions. This can be achieved by using a seamless knitting machine, a hosiery machine, or other knitting machine. Seamless attachment can also be done by continuously forming two or more portions or panels as one stretch of woven or non-woven fabric. For the purposes of this application, "free cut" means that the pieces are cut from a piece of fabric using scissors, a blade, a laser, or any other method known in the art for cutting fabric. The free cut edges are not finished with a seam or bonding.

Figure 2:
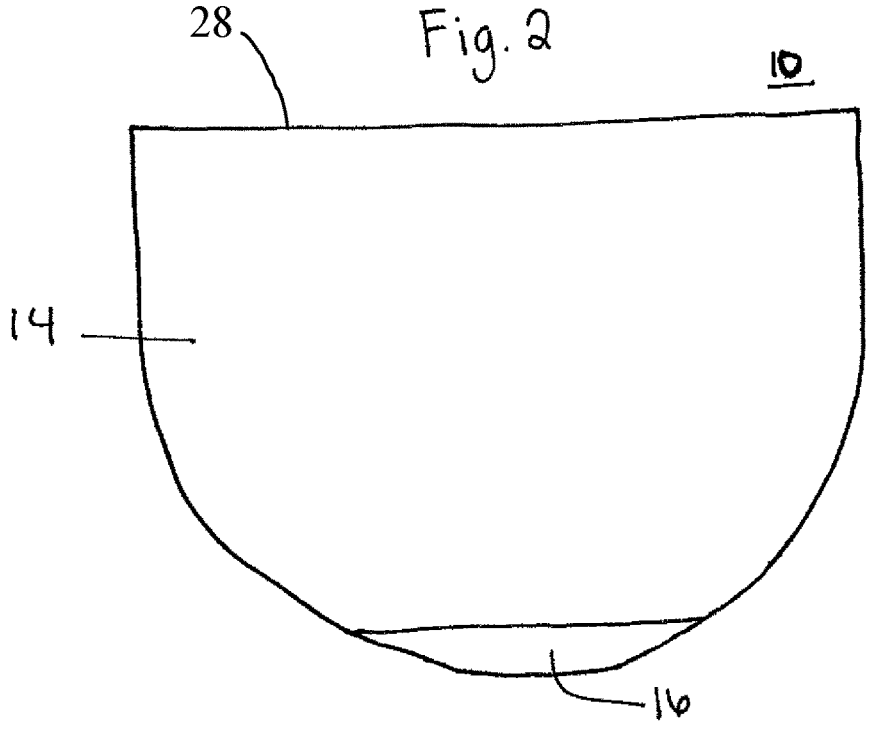
FIG. 2 is a back view of an embodiment of the undergarment.

The disclosed undergarment 10 includes a front panel 12 and a back panel 14. FIG. 1 illustrates a front view of an embodiment of an undergarment 10 having a front panel 12, a back panel 14, and a gusset panel 16. FIG. 1 illustrates one embodiment and is not intended to be limiting. The garment may include panties, thongs, shorties, boyshorts, panty bodysuits, thong bodysuits, swimsuits, or any other similar garment. FIG. 2 illustrates a back view of an embodiment of the undergarment 10 and the back panel 14. The front panel 12 and back panel 14 are fixedly or seamlessly attached along the sides to form an undergarment 10 configured for covering at least a portion of a wearer's lower body. In certain embodiments, the front panel 12 and the back panel 14 are separate pieces of fabric and are attached with a seam, bonding, or other attachment method known in the art. In other embodiments, the front panel 12 and back panel 14 are formed continuously from the same piece of fabric. The front panel 12 and back panel 14 can include any fabric known in the art for use in undergarments or shapewear, including but not limited to nylon, cotton, elastane, polyester, modal, rayon, linen, or other fabrics. In certain embodiments, the front panel 12 and the back panel 14 are a knit fabric. In certain embodiments, the undergarment 10 is configured to cover at least a portion of the wearer's lower abdominal area. In certain embodiments, the undergarment 10 is also configured to cover at least a portion of the wearer's upper body.

The front panel 12 has a left front inferior edge 18 and a right front inferior edge 20. The back panel 14 has a left back inferior edge 22 and a right back inferior edge 24. The left front inferior edge 18, right front inferior edge 20, left back inferior edge 22, and right back inferior edge 24 are free cut. In certain embodiments, the front panel 12 has a front superior edge 26, and the back panel 14 has a back superior edge 28.

The disclosed garment also includes a gusset panel 16. The gusset panel 16 extends between the front panel 12 and the back panel 14. In certain embodiments, the gusset panel 16 is a separate piece of fabric from one or both of the front panel 12 and back panel 14 and is attached to the front panel and/or back panel with a seam, bonding, or other attachment method known in the art. In other embodiments, the gusset panel 16 and one or both of the front panel 12 and back panel 14 are formed continuously from the same piece of fabric. The gusset panel 16 has a left gusset edge 30 and a right gusset edge 32. The left gusset edge 30, left front inferior edge 18, and left back inferior edge 22 define a left leg space 34. The right gusset edge 32, right front inferior edge 20, and right back inferior edge 24 define a right leg space 36.

Figure 3:
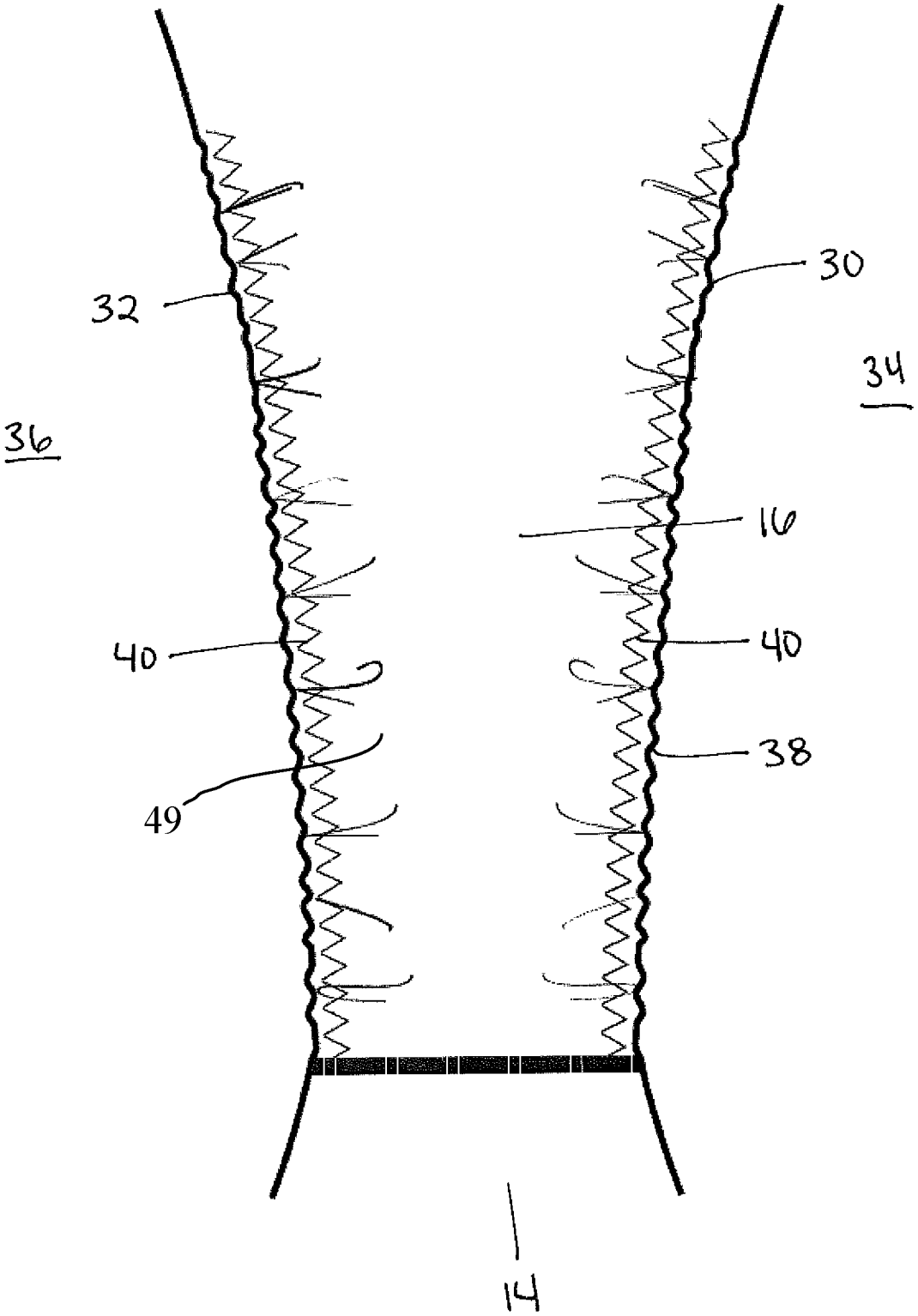
FIG. 3 is an outer view of a gusset panel of an undergarment embodiment.
Figure 4:
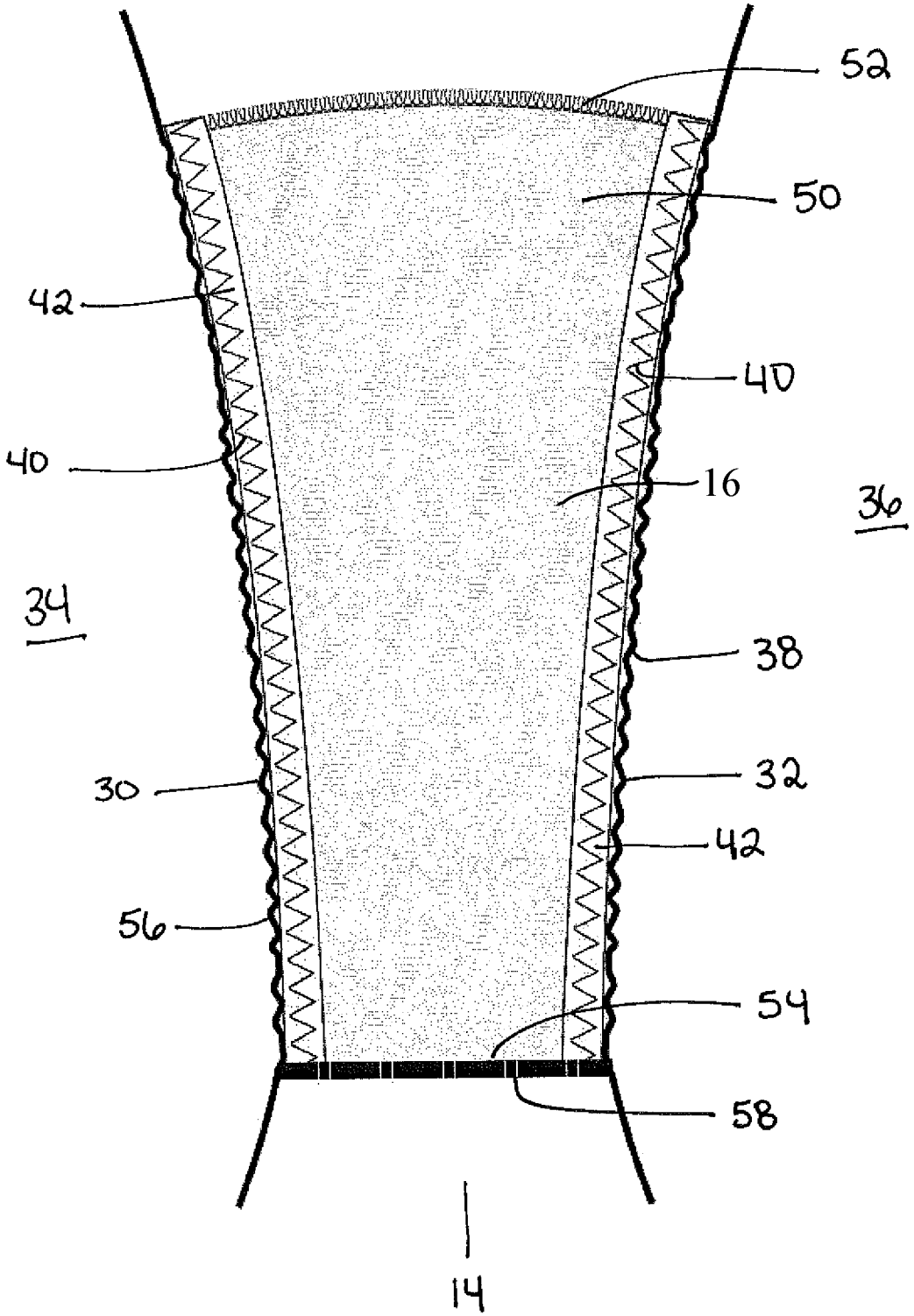
FIG. 4 is an inner view of a gusset panel of an undergarment embodiment.

In certain embodiments, the left gusset edge 30 and the right gusset edge 32 are free cut. As seen in FIGS. 3 and 4, the gusset panel 16 is gathered along the left gusset edge 30 and right gusset edge 32. The gathering 38 along the left gusset edge 30 and right gusset edge 32 provides shape to the gusset panel 16. Because of the gathering, the fabric of the gusset panel 16 will contour to the body rather than lying flat. The gathering 38 also allows the edges of the gusset panel 16 to have higher elasticity than the center of the gusset panel. In certain embodiments, the left gusset edge 30 and right gusset edge 32 have higher elasticity than the front panel 12 and back panel 14. In certain embodiments, the gusset panel 16 has a high elasticity in the side-to-side direction. In certain embodiments, the gusset panel has from about 50% to about 150% elongation in the side-to-side direction. This side-to-side stretch allows for customizable fit and coverage of the gusset panel.

In certain embodiments, the gathering 38 along the left gusset edge 30 and right gusset edge 32 is accomplished using left and right seams 40 along the left gusset edge 30 and right gusset edge 32. In certain embodiments, the undergarment 10 includes left and right elastic bands 42 on the interior surface of the gusset panel 16, along the left gusset edge 30 and right gusset edge 32. The elastic bands 42 provide additional stretch and structure to the left gusset edge 30 and right gusset edge 32. The elastic bands 42 also help anchor the undergarment 10 to the wearer's body, preventing the undergarment from moving and shifting on the body. The elastic bands 42 furthermore protect the edges of the gusset panel 16. The elastic bands 42 may be made from cotton, nylon, polyester, rayon, or other materials, and may be woven or knit elastic. In certain embodiments, the elastic bands 42 are from about 5 millimeters to about 15 millimeters wide.

Figure 5:
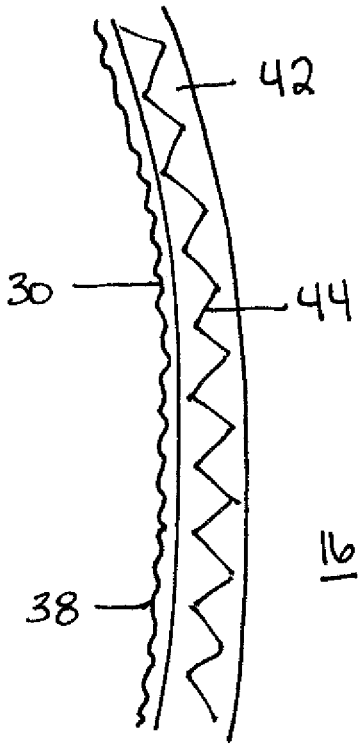
FIG. 5 is an interior view of a portion of the left edge of a gusset panel embodiment having a zig-zag stitch.
Figure 6:
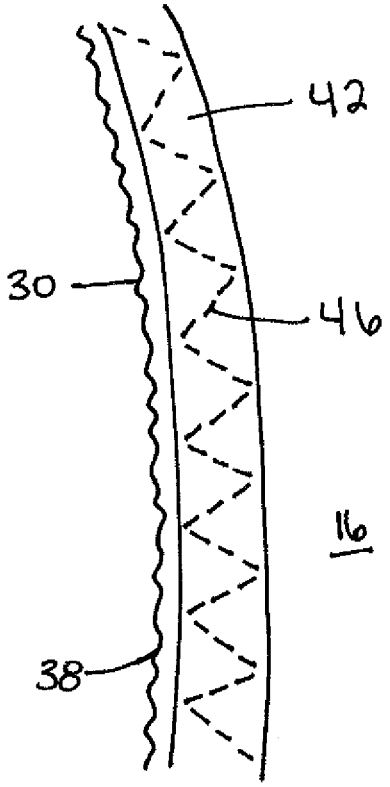
FIG. 6 is an interior view of a portion of the left edge of a gusset panel embodiment having a three-step zig-zag stitch.

In certain embodiments, the elastic bands 42 are attached along the left gusset edge 30 and right gusset edge 32 using a seam 40. In certain embodiments, the seam includes a zig-zag stitch 44. FIG. 5 illustrates an interior view of a portion of a left edge 30 of an embodiment of gusset panel 16 that includes a zig-zag stitch 44 extending along the edge 30. Left gusset edge 30 is shown in FIG. 5, but the right gusset edge 32 can also have a zig-zag stitch 44. In certain embodiments, the seam 40 is a three-step zig-zag stitch 46. FIG. 6 illustrates an interior view of a portion of a left edge 30 of an embodiment of a gusset panel 16 having a three-step zig-zag stitch 46 extending along the edge 30. In certain embodiments, the seam has from about 15 stitches per inch to about 30 stitches per inch, including about 15 stitches per inch, about 16 stitches per inch, about 17 stitches per inch, about 18 stitches per inch, about 19 stitches per inch, about 20 stitches per inch, about 21 stitches per inch, about 22 stitches per inch, about 23 stitches per inch, about 24 stitches per inch, about 25 stitches per inch, about 26 stitches per inch, about 27 stitches per inch, about 28 stitches per inch, about 29 stitches per inch, and about 30 stitches per inch. In certain embodiments, the seam can include thread made from polyester or polyester-cotton blend. In some embodiments, the elastic bands can be attached to the exterior surface of the gusset panel 16. In some embodiments, the elastic bands can be attached via bonding.

Figure 7A:
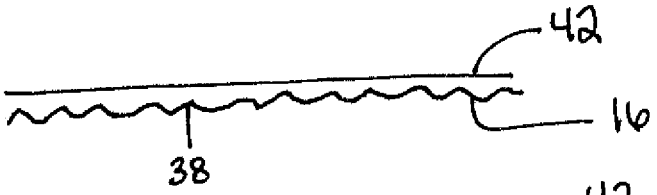
FIG. 7*a* is a side view of a portion of an edge of a gusset panel embodiment having elastic, where the elastic has caused gathering of the gusset panel fabric.
Figure 7B:
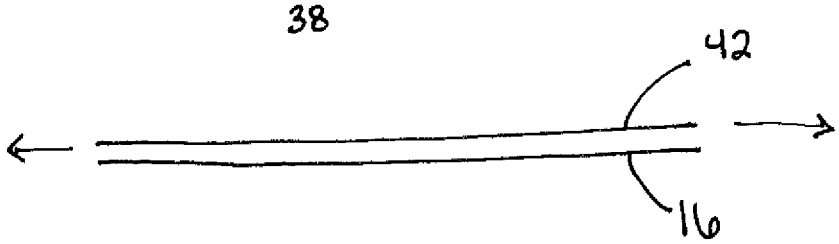
FIG. 7*b* is a side view of the portion of the edge of a gusset panel shown in FIG. 7A, where the elastic is stretched, flattening the gathering of the gusset panel fabric.
Figure 8:
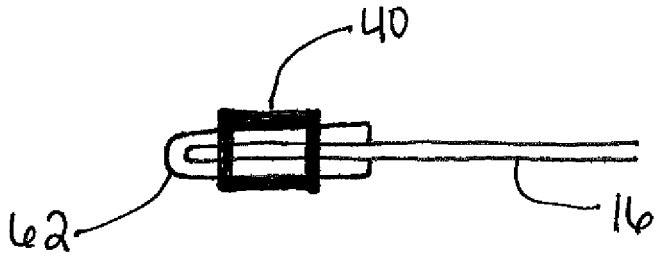
FIG. 8 is a cross-sectional view of an edge of a gusset panel embodiment having a folded elastic.

The elastic bands 42 may be attached the gusset panel 16 by applying tension to the elastic band while sewing it to the gusset panel 16, which results in gathering of the gusset panel when the tension in the elastic is released. FIGS. 7*a* and 7*b* show side views of a gusset panel 16 having an elastic band 42 attached. FIG. 7*a* shows elastic band 42 sewn to a gusset panel 16 which has slight gathering 38. FIG. 7*b* shows the gusset panel 16 being stretched in the direction of the arrows. Under stretch, the gathers of the fabric straighten out, flattening the gusset panel. However, in the normal state the gathers give the gusset panel 16 a cup-like shape that contours to the body. Combined with the elasticity at the edges of the gusset panel 16, the cup-like shape allows the gusset panel to flex and contour to different body shapes. The cup-like shape and gathering also anchors garments with free-cut or laser-cut edges to the body, holding the garments in place and preventing them from riding up.

In some embodiments, the left and right seams 40 along the left gusset edge 30 and right gusset edge 32 include elastic thread. Elastic thread may be used in addition to elastic bands 42 to provide additional stretch to the left gusset edge 30 and right gusset edge 32. However, in some embodiments, elastic thread alone can be used to gather the fabric and may be sufficient to achieve the aforementioned benefits without including elastic bands 42. For example, the elastic thread can be placed under tension while sewing the fabric. When the thread is released into a relaxed state, the fabric gathers along the seam. When the fabric is stretched, the thread elongates with the fabric.

The shirring ratio is the ratio of the length of the gathered fabric to the original length of the fabric. In some embodiments, the gusset panel has a shining ratio of from about 1:1.25 to about 1:1.3, including about 1:1.25, about 1:1.26, about 1:1.27, about 1:1.28, about 1:1.29, and about 1:1.3.

In certain embodiments, the gusset panel 16 further includes a lining 50 on, as shown in FIG. 4. The lining 50 has a front liner edge 52, a back liner edge 54, and left and right side liner edges 56. The lining 50 is on the interior of the undergarment 10, located generally between the wearer's body and the outer fabric 49 of gusset panel 16. The lining 50 provides additional comfort for the wearer. In certain embodiments, the lining 50 is between the outer fabric 49 of gusset panel 16 and the elastic bands 42. The elastic bands 42 provide protection for the left and right side liner edges 56. In certain embodiments, the lining 50, the gusset panel 16, and the elastic bands 42 are attached with a seam 40. In certain embodiments, the lining is gathered along the left and right side liner edges 56.

The lining 50 may be a breathable fabric to provide comfort for the wearer. In certain embodiments, the lining 50 is a knit fabric. In certain embodiments, the lining 50 includes cotton. In certain embodiments, the lining 50 is 100% cotton. In certain embodiments, the lining 50 is a blend of cotton and one or more materials. In certain embodiments, the lining 50 is a blend of cotton and elastane. In certain embodiments, the lining 50 includes nylon, elastane, elastic, polyester, modal, rayon, or linen. In certain embodiments, the lining 50 has a high elasticity in the side-to-side direction. This side-to-side stretch allows for customizable fit and coverage of the gusset panel 16 and the lining 50. In certain embodiments, the side-to-side stretch of the lining 50 is mechanical stretch. Lining 50 can be a single layer of fabric, or multiple layers of fabric.

In certain embodiments, the side liner edges 56 are free cut. In certain embodiments, the back liner edge 54 is attached to the undergarment 10 with a seam 58. In certain embodiments, the back liner edge 54, the back panel 14, and the gusset panel 16 are attached with a seam 58. FIG. 3 and FIG. 4 illustrate a lining 50 attached at a back liner edge 54 to the back panel 14 and the outer fabric 49 of gusset panel 16 with a seam 58. In certain embodiments, the front liner edge 52 is free cut. In certain embodiments, the front liner edge 52 is finished with a seam or bonding. In certain embodiments, the front liner edge 52 is attached to the undergarment 10.

Figure 9:
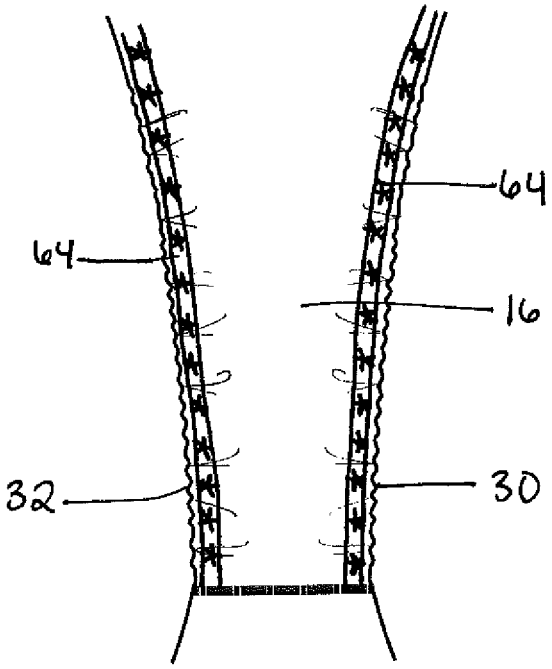
FIG. 9 is an outer view of a gusset panel of an undergarment having a decorative trim.

The undergarment 10 can further include a decorative trim 64. In certain embodiments, the garment includes a decorative trim 64 along at least the left gusset edge 30 and the right gusset edge 32. FIG. 9 illustrates an outer view of the gusset panel 16 of a garment having a decorative trim 64 along the left gusset edge 30 and right gusset edge 32. In some embodiments, decorative trim 64 is attached along the left gusset edge 30 and right gusset edge 32 by left and right seams 40. Decorative trim 64 can include lace, rickrack, elastic bands, or any other decorative material suitable for use as trim on undergarments.

Also disclosed herein is a method of making a garment having a front panel, a back panel, and a gusset panel. A method of making an undergarment includes the steps of providing a fabric, cutting a front panel, a back panel, and a gusset panel having a left gusset edge and a right gusset edge from the fabric, attaching the front panel, the back panel, and the gusset panel such that the gusset panel extends between the front panel and the back panel, and gathering the left gusset edge and the right gusset edge. In certain embodiments, the method includes providing a gusset panel that is seamlessly attached to one or both of the front and back panels. In certain embodiments, the method includes fixedly attaching the gusset panel to one or both of the front and back panels. In certain embodiments, method includes fixedly attaching the front panel and back panel along the sides with a seam, bonding, or other attachment known in the art. In other embodiments, the method includes seamlessly attaching the front panel and back panel.

In certain embodiments, the method further includes attaching a left elastic band along the left gusset edge and a right elastic band along the right gusset edge. In certain embodiments, the method includes attaching the left elastic band to the left gusset edge using a left seam and attaching the right elastic band to the right gusset edge using a right seam. In certain embodiments, the seam is a zig-zag stitch. In certain embodiments, the seam is a three-step zig-zag stitch. In certain embodiments, providing gathering to the left gusset edge and the right gusset edge includes providing left and right elastic bands, stretching the left and right elastic bands, and attaching the stretched left elastic band to the left gusset edge using a left seam and attaching the stretched right elastic band to the right gusset edge using a right seam. The seams can be a zig-zag stitch, including a three-step zig-zag stitch.

In certain embodiments, the method further includes providing a lining on the gusset panel having a back liner edge, a front liner edge, and left and right side liner edges. In certain embodiments, the method further includes attaching the lining to the gusset panel along the left and right side liner edges with left and right seams. In certain embodiments, the method includes attaching a decorative trim along at least the left gusset edge and the right gusset edge.

The invention claimed is:

1. A garment configured to cover at least a portion of the lower body, comprising:

a front panel having a left front inferior edge and a right front inferior edge, wherein the left front inferior edge and the right front inferior edge are free cut;

a back panel having a left back inferior edge and a right back inferior edge, wherein the left back inferior edge and the right back inferior edge are free cut; wherein the front panel and the back panel are fixedly or seamlessly attached along sides, and a gusset panel extending between the front panel and back panel, wherein the gusset panel comprises a free cut right gusset edge and a free cut left gusset edge; wherein the gusset panel is seamlessly attached to the front panel and the back panel;

wherein the left gusset edge and the left front inferior edge and left back inferior edge define a left leg space, and wherein the right gusset edge and the right front inferior edge and the right back inferior edge define a right leg space;

and wherein the gusset panel is gathered along the left gusset edge and right gusset edge.

2. The garment of claim 1, further comprising an interior surface and a left elastic band or thread attached to and extending along the left gusset edge of the interior surface of the garment and a right elastic band or thread attached to and extending along the right gusset edge of the interior surface of the garment, wherein the attachment of the left and right elastic bands or threads to the left and right gusset edges gather the left and right gusset edges, wherein the left elastic band or thread is a left elastic band or thread attached to the left gusset edge by a left seam and the right elastic band or thread is a right elastic band or thread attached to the right gusset edge by a right seam, wherein the left seam comprises a plurality of stitches, and wherein the right seam comprises a plurality of stitches.

3. The garment of claim 2, wherein the elastic band or thread is an elastic band or thread comprising a woven or a knit elastic.

4. The garment of claim 2, wherein the plurality of stitches of the left and right seams comprise a zig-zag stitch.

5. The garment of claim 4, wherein the zig-zag stitch has from 15 to 30 stitches per inch.

6. The garment of claim 1, wherein the gusset panel has a shirring ratio of from 1:1.25 to 1:1.3.

7. The garment of claim 1, wherein the gusset panel further comprises a lining located on an interior surface of the garment and an outer fabric located on an exterior surface of the garment.

8. The garment of claim 1, wherein the front panel and/or the back panel are formed from a first piece of fabric, and the gusset panel is formed from the first piece of fabric.

9. The garment of claim 1, wherein the front panel further comprises a front superior edge, and the back panel further comprises a back superior edge, and wherein the front superior edge and the back superior edge are free cut.

10. The garment of claim 1, wherein the left gusset edge and the right gusset edge further comprise a decorative trim.

11. The garment of claim 1, further comprising a lining, the lining having an exterior surface, an interior surface, a left lining edge and a right lining edge, wherein the exterior surface of the lining is attached to the interior surface of the garment that corresponds to the gusset panel.

12. The garment of claim 11, further comprising a left elastic band or thread sewn to and extending along the left lining edge of the interior surface of the lining and a right elastic band or thread sewn to and extending along the right lining edge of the interior surface of the lining such that the left elastic band or thread and right elastic band or thread couple the liner to the gusset panel.

13. A method of making an undergarment, the method comprising:

providing a fabric, cutting a front panel, a back panel having a left back inferior edge and a right back inferior edge, and a gusset panel having a left gusset edge and a right gusset edge from the fabric;

attaching the front panel, the back panel, and the gusset panel such that the gusset panel extends between the front panel and the back panel; wherein the gusset is seamlessly or fixedly attached to the front panel and the back panel and wherein the front panel and the back panel are fixedly or seamlessly attached along sides, and gathering the left gusset edge and the right gusset edge, wherein the left gusset edge, right gusset edge, left back inferior edge, and right back inferior edge are free cut.

14. The method of claim 13, further comprising sewing a left elastic band or thread along the left gusset edge and a right elastic band or thread along the right gusset edge.

15. The method of claim 14, wherein sewing a left elastic band or thread along the left gusset edge further comprises attaching a left elastic band to the left gusset edge using a left seam, and wherein sewing a right elastic band or thread along the right gusset edge further comprises attaching a right elastic band to the right gusset edge using a right seam.

16. The method of claim 15, wherein the left seam and/or right seam comprise a zig-zag stitch.

17. The method of claim 16, wherein the left seam and/or right seam comprise a three-step zig-zag stitch.

18. The method of claim 13, wherein gathering the left gusset edge comprises stretching a left elastic band or thread and attaching the stretched left elastic band or thread along the left gusset edge, and wherein gathering a right gusset edge comprises stretching a right elastic band or thread and attaching the stretched right elastic band or thread along the right gusset edge.

19. The method of claim 18, wherein gathering the left and right gusset edges further comprises stitching a left elastic band or thread along the left gusset edge and stitching a right elastic band or thread along the right gusset edge.

20. A garment configured to cover at least a portion of the lower body, comprising:

a front panel having a left front inferior edge and a right front inferior edge, wherein the left front inferior edge and the right front inferior edge are free cut;

a back panel having a left back inferior edge and a right back inferior edge, wherein the left back inferior edge and the right back inferior edge are free cut; wherein the front panel and the back panel are fixedly or seamlessly attached along sides, and a gusset panel extending between the front panel and back panel, wherein the gusset panel comprises a free cut right gusset edge and a free cut left gusset edge; wherein the gusset panel is fixedly attached to the front panel and the back panel;

wherein the left gusset edge and the left front inferior edge and left back inferior edge define a left leg space, and wherein the right gusset edge and the right front inferior edge and the right back inferior edge define a right leg space;

and wherein the gusset panel is gathered along the left gusset edge and right gusset edge.

* * * * *